US011653696B2

(12) United States Patent
Liu

(10) Patent No.: US 11,653,696 B2
(45) Date of Patent: May 23, 2023

(54) LEAK-PROOF DEVICE AND ELECTRONIC CIGARETTE COMPRISING THE SAME

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 367 days.

(21) Appl. No.: 17/015,031

(22) Filed: Sep. 8, 2020

(65) Prior Publication Data

US 2021/0186098 A1 Jun. 24, 2021

(30) Foreign Application Priority Data

Dec. 18, 2019 (CN) ..... 201922292040.9

(51) Int. Cl.
*A24F 40/10* (2020.01)
*A24F 40/42* (2020.01)
*A24F 40/485* (2020.01)

(52) U.S. Cl.
CPC ..... *A24F 40/10* (2020.01); *A24F 40/42* (2020.01); *A24F 40/485* (2020.01)

(58) Field of Classification Search
CPC ..... A24F 40/10; A24F 40/42; A24F 40/485
See application file for complete search history.

(56) References Cited

U.S. PATENT DOCUMENTS 9,867,399 B1 * 1/2018 Liu ..... A24F 40/42

FOREIGN PATENT DOCUMENTS

RU 2658213 * 6/2018

* cited by examiner

*Primary Examiner* — Jean F Duverne
(74) *Attorney, Agent, or Firm* — Matthias Scholl P.C.; Matthias Scholl

(57) ABSTRACT

A leak-proof device for an electronic cigarette, including a first seal ring, an upper cover, a base, a second seal ring, and an insulation ring. The first seal ring is disposed on the top end of the upper cover to seal an e-liquid tank thereby isolating the e-liquid in the e-liquid tank. The base includes a first recess. The second seal ring is disposed on the base. The base is disposed on the bottom end of the e-liquid tank to seal the bottom end of the e-liquid tank. The insulation ring includes a second recess and is disposed on the bottom of the base to collect e-liquid condensate.

4 Claims, 5 Drawing Sheets

LEAK-PROOF DEVICE AND ELECTRONIC CIGARETTE COMPRISING THE SAME

CROSS-REFERENCE TO RELAYED APPLICATIONS

Pursuant to 35 U.S.C. § 119 and the Paris Convention Treaty, this application claims foreign priority to Chinese Patent Application No. 201922292040.9 filed Dec. 18, 2019, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to an electronic cigarette.

A conventional electronic cigarette includes an atomization assembly and a battery assembly. The atomization assembly comprises an air inlet and an air passage, and has no double leak-proof functions.

SUMMARY

The disclosure provides a leak-proof device, comprising a first seal ring, an upper cover, a base, a second seal ring, and an insulation ring; the first seal ring is disposed on the top end of the upper cover to seal an e-liquid tank thereby isolating the e-liquid in the e-liquid tank; the base comprises a first recess; the second seal ring is disposed on the base; the base is disposed on the bottom end of the e-liquid tank to seal the bottom end of the e-liquid tank; the insulation ring comprises a second recess and is disposed on the bottom of the base to collect the e-liquid condensate. Thus, the leak-proof device has a double leak-proof effect.

The leak-proof device further comprises a heating wire, a strip of cotton, and a seal pad; the heating wire is nested in the strip of cotton to atomize absorbed e-liquid on the strip of cotton; the upper cover is disposed on the strip of cotton; the strip of cotton is disposed in the first recess of the base to absorb deposited e-liquid in the recess; the seal pad is disposed on the top part of the base to seal the e-liquid.

The disclosure also provides an electronic cigarette, comprising an atomization assembly and a battery assembly; the atomization assembly comprises the aforesaid leak-proof device.

The electronic cigarette further comprises an air guide module; the air guide module comprises a joint comprising an air inlet; when in use, the air enters the electronic cigarette via the air inlet, passes through an air passage, and is discharged from the top part of the atomization assembly.

The air guide module further comprises the insulation ring; the joint is disposed in the insulation ring for electric conduction and air conduction; the insulation ring is disposed in the base as a carrier of the joint.

The atomization assembly is disposed on one end of the battery assembly. The atomization assembly is connected to the battery assembly through the magnetic attraction between the magnet and the iron shell. The leak-proof device of the atomization assembly can absorb deposited e-liquid and collect e-liquid condensate, thereby prevent the deposited e-liquid or e-liquid condensate from flowing into the battery assembly, thus avoiding short circuit. The atomization assembly further comprises an air guide module. The air guide module comprises a joint comprising an air inlet. When in use, the air enters the electronic cigarette via the air inlet, passes through the air passage, and is discharged from the top part of the atomization assembly.

DETAILED DESCRIPTION

To further illustrate, embodiments detailing an electronic cigarette are described below. It should be noted that the following embodiments are intended to describe and not to limit the disclosure.

Figure 1:
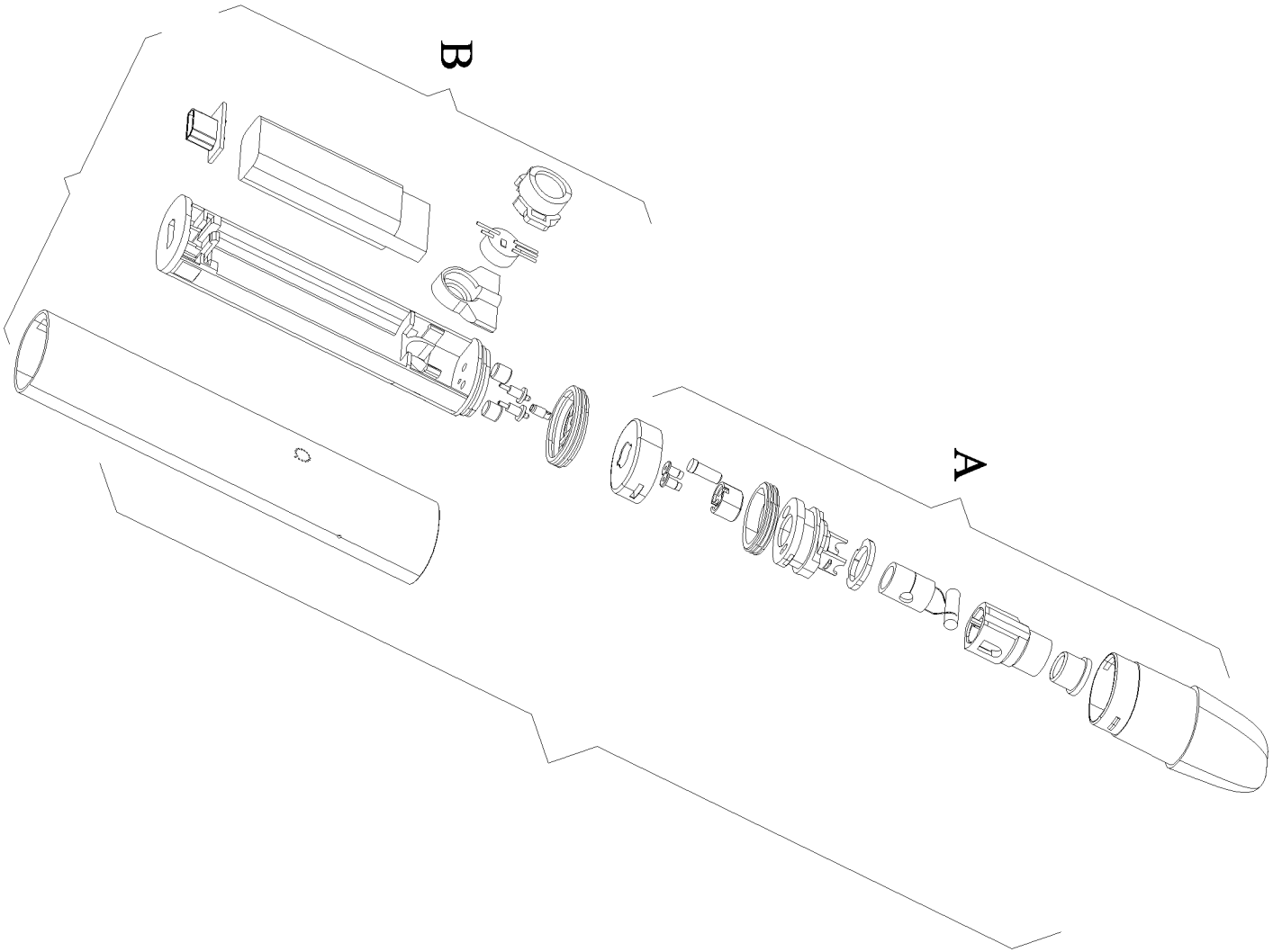
FIG. 1 is an exploded view of an electronic cigarette according to one embodiment of the disclosure.
Figure 2:
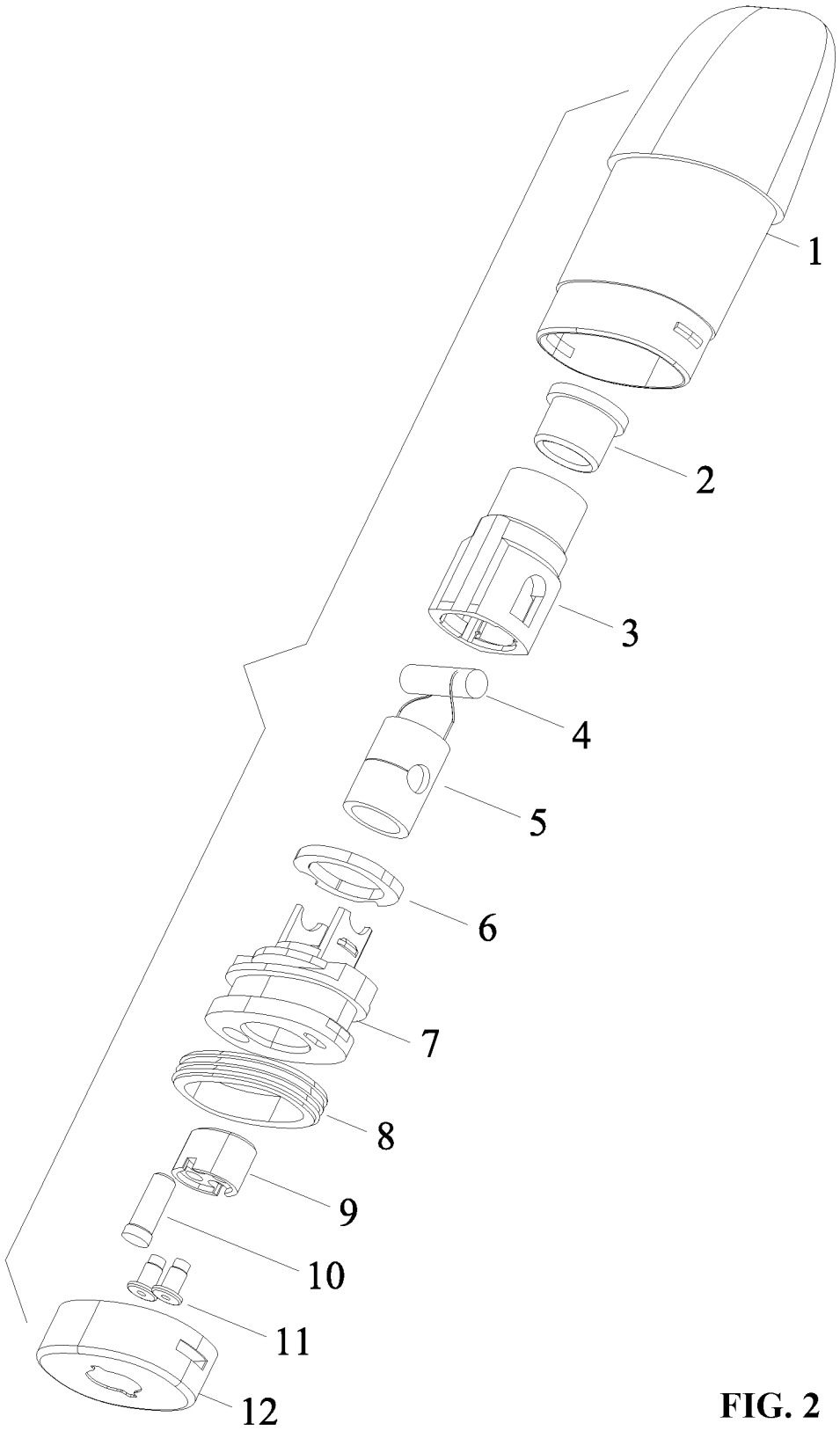
FIG. 2 is an exploded view of an atomization assembly of an electronic cigarette according to one embodiment of the disclosure.
Figure 3:
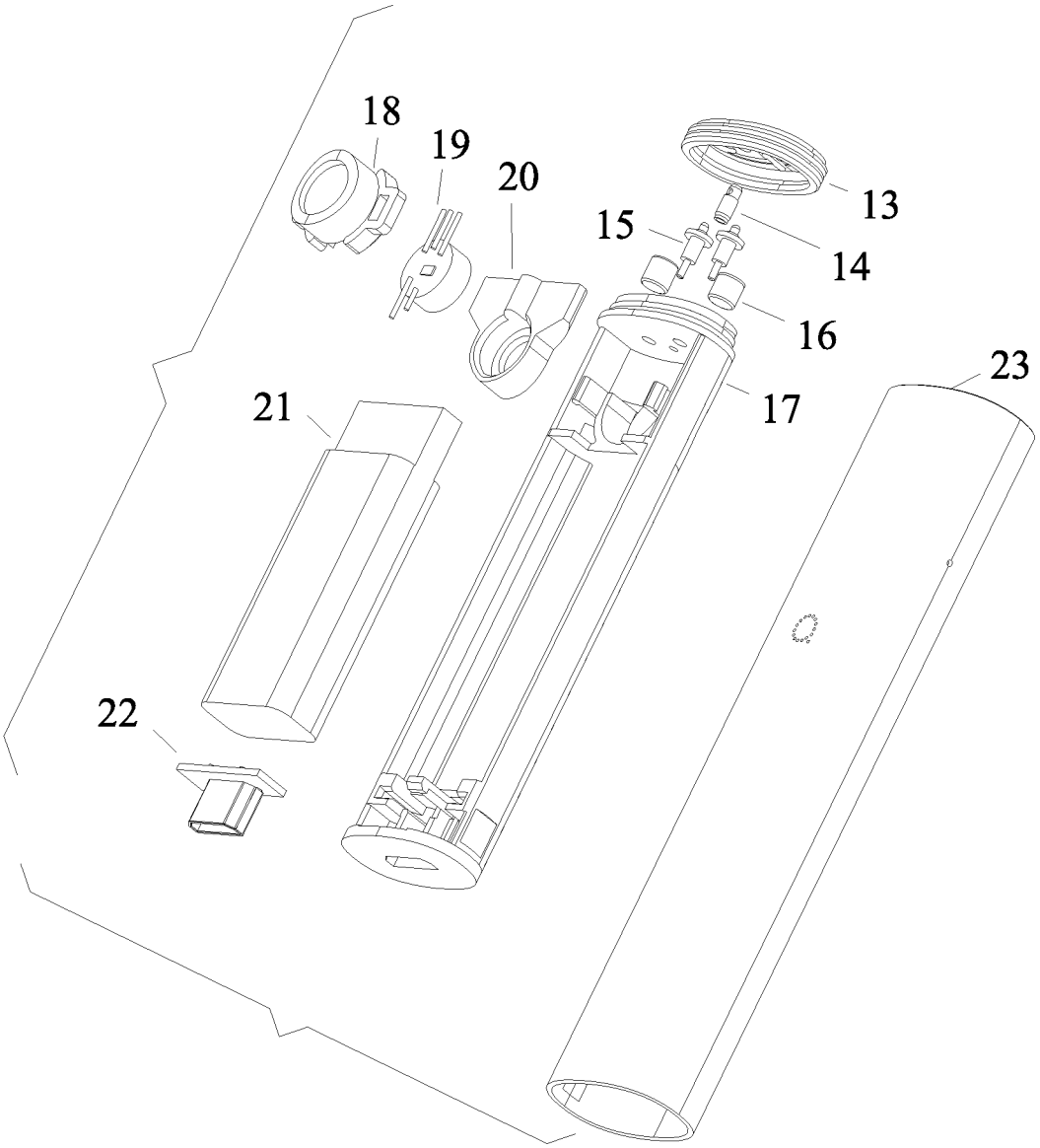
FIG. 3 is an exploded view of a battery assembly of an electronic cigarette according to one embodiment of the disclosure.
Figure 4:
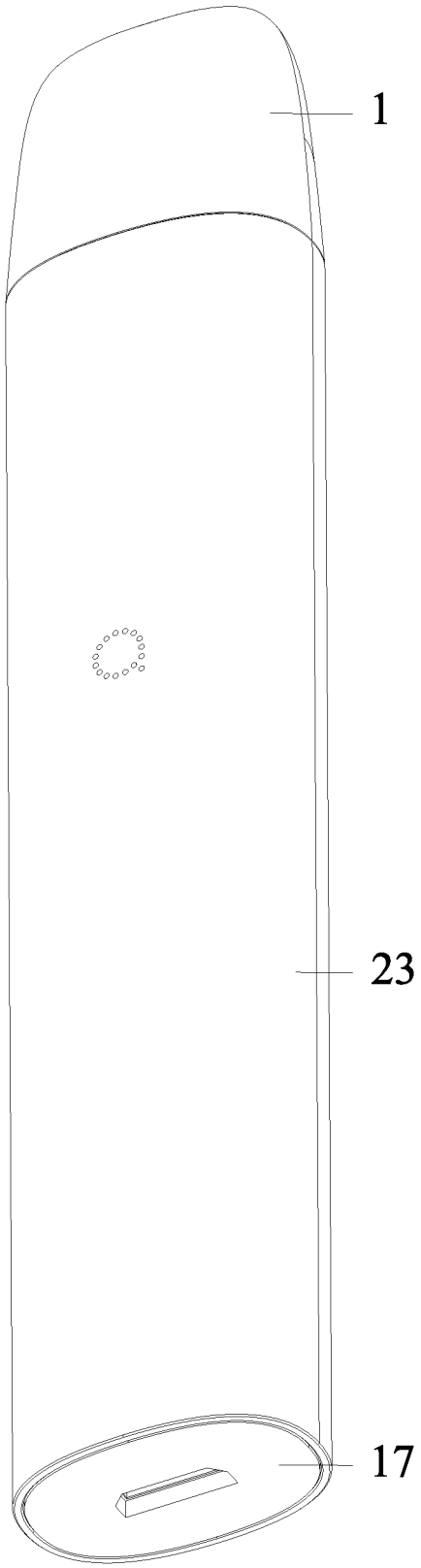
FIG. 4 is a schematic diagram of an electronic cigarette according to one embodiment of the disclosure.
Figure 5:
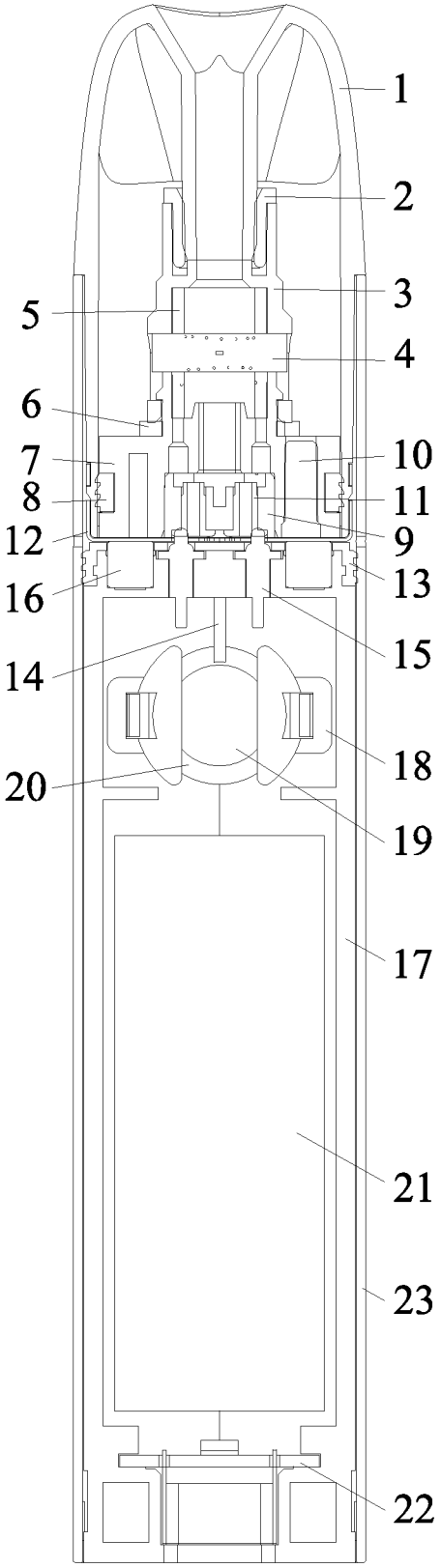
FIG. 5 is a sectional view of an electronic cigarette according to one embodiment of the disclosure.

As shown in FIGS. 1-5, an electronic cigarette comprises an atomization assembly A and a battery assembly B. The atomization assembly is disposed on one end of the battery assembly B. The battery assembly comprises a magnet 16 and the atomization assembly comprises an iron shell 12. The atomization assembly is connected to the battery assembly through the magnetic attraction between the magnet 16 and the iron shell 12. Specifically, the atomization assembly A comprises an e-liquid tank 1, a first seal ring 2, an upper cover 3, a heating wire 4, a strip of cotton 5, and a seal pad 6, a base 7, a second seal ring 8, and an insulation ring 9, a seal plug 10, a joint 11, and an iron shell 12. The heating wire 4 is horizontally inserted in the strip of cotton 5 to atomize the absorbed e-liquid on the strip of cotton. The upper cover 3 is disposed on the strip of cotton 5 to isolate the e-liquid in the e-liquid tank 1. The first seal ring 2 is disposed on the top end of the upper cover 3 to seal the internal air passage of the e-liquid tank 1. The base 7 comprises a first recess. The strip of cotton 5 is disposed in the first recess of the base 7 to absorb deposited e-liquid in the recess. The seal pad 6 is disposed on the top part of the base 7 to seal the e-liquid. The second seal ring 8 is disposed on the base 7; the base 7 is disposed on the bottom end of the e-liquid tank 1 to seal the bottom end of the e-liquid tank 1. The insulation ring 9 comprises a second recess and is disposed on the bottom of the base 7 to collect e-liquid condensate. The joint 11 comprises an air inlet and is disposed in the insulation ring 9 for electric conduction and air conduction. As a carrier of the joint 11, the insulation ring 9 is installed in the base 7 and communicates with the internal airway of the atomization assembly. The seal plug 10 is disposed on the bottom of the base 7 to seal the e-liquid injection hole of the base 7. The iron shell 12 is disposed on the bottom of the e-liquid tank 1.

The battery assembly B comprises a third seal ring 13, an air column 14, a spring contact 15, a magnet 16, a main support 17, a silicone light guide 18, a pneumatic switch 19, a silicone gasket 20, a battery 21, a USB panel 22, and a housing 23. The third seal ring 13 is disposed on the main support 17 to prevent air leakage. The spring contact 15 is disposed on the top of the main support 17 for air conduction. The air column 14 runs through the top part of the main support 17 to support the internal air passage of the joint 11 of the atomization assembly. The silicone gasket 20 is disposed in the main support 17. The upper part of the silicone gasket 20 is connected to the lower part of the air column 14 so as to drive the pneumatic switch 19 to work upon inhaling. The pneumatic switch 19 is disposed in the silicone gasket 20 and is fixed on the main support 17. The silicone light guide 18 is disposed on the pneumatic switch 19. The USB panel 22 is soldered to the pneumatic switch 19 and the pneumatic switch 19 is soldered to the battery so as to charge the battery 21. The main support 17 is disposed in the housing 23.

The atomization assembly is disposed on one end of the battery assembly. The atomization assembly is connected to the battery assembly through the magnetic attraction between the magnet and the iron shell. The leak-proof device of the atomization assembly can absorb deposited e-liquid and collect e-liquid condensate, thereby prevent the deposited e-liquid or e-liquid condensate from flowing into the battery assembly, thus avoiding short circuit. The atomization assembly further comprises an air guide module. The air guide module comprises the joint comprising an air inlet. When in use, the air enters the electronic cigarette via the air inlet, passes through the air passage, and is discharged from the top part of the atomization assembly.

It will be obvious to those skilled in the art that changes and modifications may be made, and therefore, the aim in the appended claims is to cover all such changes and modifications.

What is claimed is:

1. A leak-proof device comprising a first seal ring, an upper cover, a base, a second seal ring, an insulation ring, a heating wire, a strip of cotton, and a seal pad; wherein:

the first seal ring is disposed on a top end of the upper cover to seal an e-liquid tank thereby isolating the e-liquid in the e-liquid tank;

the base comprises a first recess;

the second seal ring is disposed on the base;

the base is disposed on a bottom end of the e-liquid tank to seal the bottom end of the e-liquid tank;

the insulation ring comprises a second recess, and is disposed on a bottom of the base to collect e-liquid condensate;

the heating wire is nested in the strip of cotton to atomize absorbed e-liquid on the strip of cotton;

the upper cover is disposed on the strip of cotton;

the strip of cotton is disposed in the first recess of the base to absorb deposited e-liquid in the recess; and the seal pad is disposed on a top part of the base to seal the e-liquid.

2. An electronic cigarette, comprising an atomization assembly and a battery assembly; the atomization assembly comprising the leak-proof device of claim 1.

3. An electronic cigarette comprising:

an atomization assembly, a battery assembly, and an air guide module; the atomization assembly comprising a leak-proof device; wherein:

the leak-proof device comprises a first seal ring, an upper cover, a base, a second seal ring, and an insulation ring;

the first seal ring is disposed on a top end of the upper cover to seal an e-liquid tank thereby isolating the e-liquid in the e-liquid tank;

the base comprises a first recess;

the second seal ring is disposed on the base;

the base is disposed on a bottom end of the e-liquid tank to seal the bottom end of the e-liquid tank;

the insulation ring comprises a second recess and is disposed on a bottom of the base to collect e-liquid condensate;

the air guide module comprises a joint comprising an air inlet;

when in use, the air enters the electronic cigarette via the air inlet, passes through an air passage, and is discharged from a top part of the atomization assembly.

4. The electronic cigarette of claim 3, wherein the air guide module further comprises the insulation ring; the joint is disposed in the insulation ring for electric conduction and air conduction; the insulation ring is disposed in the base as a carrier of the joint.

* * * * *